US006918497B2

(12) United States Patent
Davis

(10) Patent No.: US 6,918,497 B2
(45) Date of Patent: Jul. 19, 2005

(54) STRUCTURAL SYSTEM OF INTERLOCKING SHEETS

(76) Inventor: Glenn Nicholas Davis, 729 Medford, Hayward, CA (US) 94541

( * ) Notice: Subject to any disclaimer, the term of this patent is extended or adjusted under 35 U.S.C. 154(b) by 98 days.

(21) Appl. No.: 10/310,626

(22) Filed: Dec. 5, 2002

(65) Prior Publication Data

US 2004/0108290 A1 Jun. 10, 2004

(51) Int. Cl.[7] ..... A47F 5/00

(52) U.S. Cl. ..... 211/183; 211/186

(58) Field of Search ..... 211/183, 186, 211/189, 134, 195, 188; 206/561; 312/195; 220/507, 510, 541–542, 529, 533, 552–554; 108/106, 147.11, 147.15, 180, 101, 159, 158.12

(56) References Cited

U.S. PATENT DOCUMENTS 1,934,846 A * 11/1933 Ludwig ..... 108/101
2,526,246 A * 10/1950 Benjamin ..... 108/101
3,141,423 A * 7/1964 Christensen ..... 108/190
3,338,189 A * 8/1967 Xavier ..... 108/183
3,612,289 A * 10/1971 Zink ..... 108/180
3,669,033 A * 6/1972 Murcia ..... 108/180
3,722,431 A * 3/1973 Howard ..... 108/157.13
3,806,124 A * 4/1974 Ippen et al. ..... 273/241
4,125,338 A 11/1978 Lew
4,232,916 A * 11/1980 Correia ..... 312/107
4,338,866 A * 7/1982 Streit ..... 108/191
4,345,526 A * 8/1982 Streit ..... 108/191
4,562,776 A * 1/1986 Miranda ..... 108/190
4,701,065 A 10/1987 Orosa
5,117,989 A * 6/1992 Ross ..... 211/144
5,140,915 A 8/1992 Knape
5,148,928 A 9/1992 Arnold
5,701,827 A * 12/1997 Urabe ..... 108/56.1
6,126,022 A * 10/2000 Merkel ..... 211/135
6,138,583 A 10/2000 Mahone
6,443,319 B1 9/2002 Sander
6,578,716 B1 * 6/2003 Wei ..... 211/33
6,675,979 B2 * 1/2004 Taylor ..... 211/186

* cited by examiner

*Primary Examiner*—Jennifer E. Novosad
(74) *Attorney, Agent, or Firm*—Gary Baker; Quine Intellectual Property Law Group, P.C.

(57) ABSTRACT

The structural system of the invention provides, e.g., column members and planar members made of sheet materials interlocked to form frames for buildings and furniture. The members can be cut from sheet stock material, or injection molded, then assembled into useful configurations by interlocking column members then inserting the interlocked columns into close fitting pierced regions of planar members.

11 Claims, 7 Drawing Sheets

STRUCTURAL SYSTEM OF INTERLOCKING SHEETS

BACKGROUND OF THE INVENTION

1. Field of the Invention

The invention relates, e.g., to three dimensional structural systems made from interlocking planar sheets of material. The structural system of the invention provides, e.g., sturdy interlocked columns and shelves that are easy to assemble from a minimum of material. The structural system can be configured, e.g., to provide attractive, inexpensive, and functional furniture.

2. Description of Related Art

There exists a wide range of structural frame, furniture, and shelving systems. Box frames are ancient and still common systems for framing structures. Box frames have been used, for example in buildings, transportation systems, and furniture. The outer walls of such box frames receive compressive forces while supporting tops or shelves. Such frames can contain a large volume without excessive use of materials but provide weak support in central horizontal regions of the structure. Box frame structures can also be heavy because shear walls may be required to prevent diamonding of edge supports. Without such "shear walls" to prevent articulation at the joints between the base, walls, and top, the whole structure can collapse when the structure is under the stress of lateral forces.

With the appearance of modem materials and designs, elegant central column structures have become more common, especially in architecture. Structures with central frame members have the advantage of lightness and openness. Tall buildings have evolved from cathedrals with heavy outer buttressed structural walls to skyscrapers with internal steel and concrete support columns supporting lighter outer walls. Central columns are located near the center of the weight they support, so horizontal surfaces can be lighter without sagging. Center supports allow outer non-structural walls and floors to be lighter and more open to light and movement. For example, modem skyscrapers often have an internal frame of structural columns so that offices can enjoy abundant windows and maximum peripheral floor space without the intrusion of heavy external structural walls or columns.

The internal frames of buildings are usually made up of a multitude of vertical and horizontal steel beams that are attached to each with rivets or bolts. A typical beam for these frames in an "I-beam" having a cross section shaped like the letter I to provide strength in two dimensions against lateral forces while the beam as a whole provides compressive or tensile strength in the axial dimension. Such beams systems are weakest at the joints where they bolt together and can be quite bulky to transport.

Shelving has also evolved from heavy outer box frame designs, to lighter units mounted on walls or supported on poles. Yet, many of the modern designs trade bulky support systems for thinner central supports dependent on expensive modern materials. Some shelving, such as the system described in U.S. Pat. No. 5,148,928, "Shelf System", to Arnold, provide thin outer support columns. The Arnold shelf system uses a minimum of materials while providing easy access and view of objects placed on the shelves. However, the columns must be made from a strong material, such as steel, and the shelf system is not free standing. Other light weight shelving systems include metal tracks that must be mounted to a wall for support of mounting brackets and shelves. Again, this system uses a minimum of materials but must be mounted to another structure for support. It has been observed that metal shelving systems of these types do not have a pleasing appearance.

A need remains for a structural system of columns and shelves that is light and strong that uses a minimum of simple materials to construct. It is desirable to have free standing support columns for floors or shelving that do not require bulky walls that block passage of objects or light. The present invention solves these problems, as will be made evident in the disclosure that follows.

SUMMARY OF THE INVENTION

The structural systems of the invention are, e.g., planar members pierced to be closely mounted onto interlocked columns of slit column members. Planar members can be mounted to interlocked columns by wedging, peg supports, locking clips, and the like. Combinations of interlocked columns and planar members can be configured, e.g., to provide, a structural framework, shelving, and furniture. The structural systems of the invention can be manufactured by, e.g., cutting, stamping and/or injection molding the structural members which are assembled by inserting interlocked column members into pierced regions of planar members.

The structural system of the invention includes, e.g., two or more column members and one or more planar members. The column members each have one or more slits adapted to receive the non-slit portions of other column members to form an interlocked column. The planar members have one or more pierced regions adapted to receive the interlocked columns with strength in three dimensions. The planar members can, e.g., surround a cross section and mount to an interlocked column to provide a structural system of planar members supported by interlocked columns.

The structural system can be provided in a variety of configurations from a single planar member mounted to a single central interlocked column, to a building structure or desk made up of multiple column units supporting multiple planar member units. Column members can act as, e.g., columns, walls and vertical frame sections as desired. Planar members can act as ceilings, floors, shelves, seating surfaces, desk tops, drawer supports, counter tops, table tops, etc., of desired structures. In one embodiment, the system can include two interlocked columns supporting two or more planar members to provide, e.g., a shelf system. A base member with recesses adapted to closely receive the bottom end of interlocked columns can be used to provide a wide base surface for the structural system.

The planar members of the invention can be mounted to the interlocked columns in a variety of ways known in the art. This can include, e.g., adhesives, nails, screws, wedging, pegs, clips, and/or the like. For example, the structural system can include interlocked columns with tapered outer edges so that the planar members receive columns until the cross sections of the columns wedge in the pierced regions to support the planar members. Alternately, the mounting method of the structural system can include, e.g., pegs to closely fit into holes on the interlocked columns. The pegs can extend in part from the holes in the interlocked columns, to contact and support planar members from one side. Additional pegs in column holes can be added above the supported planar members to contact the other side of the planar member, preventing upward movement.

An angled clip can be added to the peg system to lock the planar member in a mounted position on the column. The angled clip can have a perforated section comprising a perforation to receive a peg, and a clip contact section to hold one side of the planar member in place. The perforated section can extend between the planar member and the interlocked column so that the perforation aligns with a column hole; the clip contact section remaining in contact with, e.g., the top side of the planar member. The column hole can receive a peg through the clip perforation so the planar member is mounted between the peg on the bottom side and the clip contact section on the top side.

The structural system can be configured as a desk or shelf system with electrical lighting mounted to the planar members or columns. Such lighting can provide, e.g., reading light or back lighting for a display.

Although not necessary for many embodiments, diagonal bracing can be included across members of the structural system to add rigidity against lateral forces.

Methods of the invention include ways to fabricate and assemble the structural system. A method of manufacturing the structural system of the invention can include fabricating two or more column members with slits and at least one planar member with a pierced region, interlocking the column members to form one or more interlocked columns, inserting the interlocked columns the pierced regions of the planar members which surround the cross sections of the interlocked columns, and mounting the planar members to the interlocked columns to form the structural system of planar members supported by interlocked columns.

Mounting the planar members to the interlocked columns can be accomplished by, e.g., inserting pegs into holes in the interlocked column and supporting the planar members on the pegs. The planar members can be further locked into place by inserting perforated sections of angled clips between the planar members and the interlocked columns so that clip perforations align with the holes, then inserting the pegs into the holes through the clip perforations to mount the planar member between the peg on one side and a clip contact section on the other planar member side. Optionally, the mounting can be accomplished by wedging the planar member onto an interlocked column with a tapered outer edge.

BRIEF DESCRIPTION OF THE DRAWINGS

The invention will now be more particularly described in connection with its preferred embodiments and with reference to the accompanying drawings wherein.

DETAILED DESCRIPTION OF THE INVENTION

The structural system of the invention can have, e.g., as few as three parts that form a column holding a shelf (planar member). The interlocked column can be made, e.g., from two column members that interlock axially with the planes of the column members crossing at the axis. The planar member can be made, e.g., from a sheet of solid material a pierced with a hole (pierced region) having the substantially the dimensions of an interlocked column cross section. The planar member can be frictionally mounted onto the interlocked column, e.g., by inserting a tapered interlocked column into the pierced region and sliding the planar member to a position where the interlocked column cross section matches the pierced region dimensions. The planar member can become wedged onto the interlocked column or the shelf can be fastened to the interlocked column in any number of ways known in the art. Multiple interlocked columns and planar members can be assembled, e.g., to extend in 2 or 3 dimensions to provide frameworks that support buildings, shelving and furniture.

The structural system of the invention can be arranged to provide advantages, e.g., in efficient use of materials, access to the inner frame volume, strength, compact shipping, and ease of assembly. For example, shelving can be provided from a small number of light sheet-like components that can be stacked in a small volume for transport but quickly assembled by interlocking the sheets to provide rigid support in three dimensions while leaving large internal spaces unblocked by outer walls. Such a shelf system provides easy access to placed objects without blocking the view beyond.

Although the interlocked columns generally act as a vertical support for the planar members of the system, those skilled in the art can appreciate that the system can be usefully placed in other orientations. For example, a horizontal interlocked column can be supported by inserting it through two vertical planar members. In such an orientation, planar members can provide support against vertical compression, for example, while one column member presents as a useful "shelf" and the other column member presents as a back wall or edge stop to the shelf surface.

The structural system can be fabricated from sheets of any suitable material with tensile and compressive strength adequate for the particular embodiment. Materials well adapted to the invention include, e.g., wood, plywood, plastic sheets, particle board, steel, aluminum, glass, and the like. The system column members and/or planar members can be cut or stamped from the sheets, or injection molded. Although flat sheets with parallel surfaces are suitable for many embodiments, the sheets can have tapered thickness and/or curved surfaces in some embodiments.

The Interlocked Columns

Figure 1:
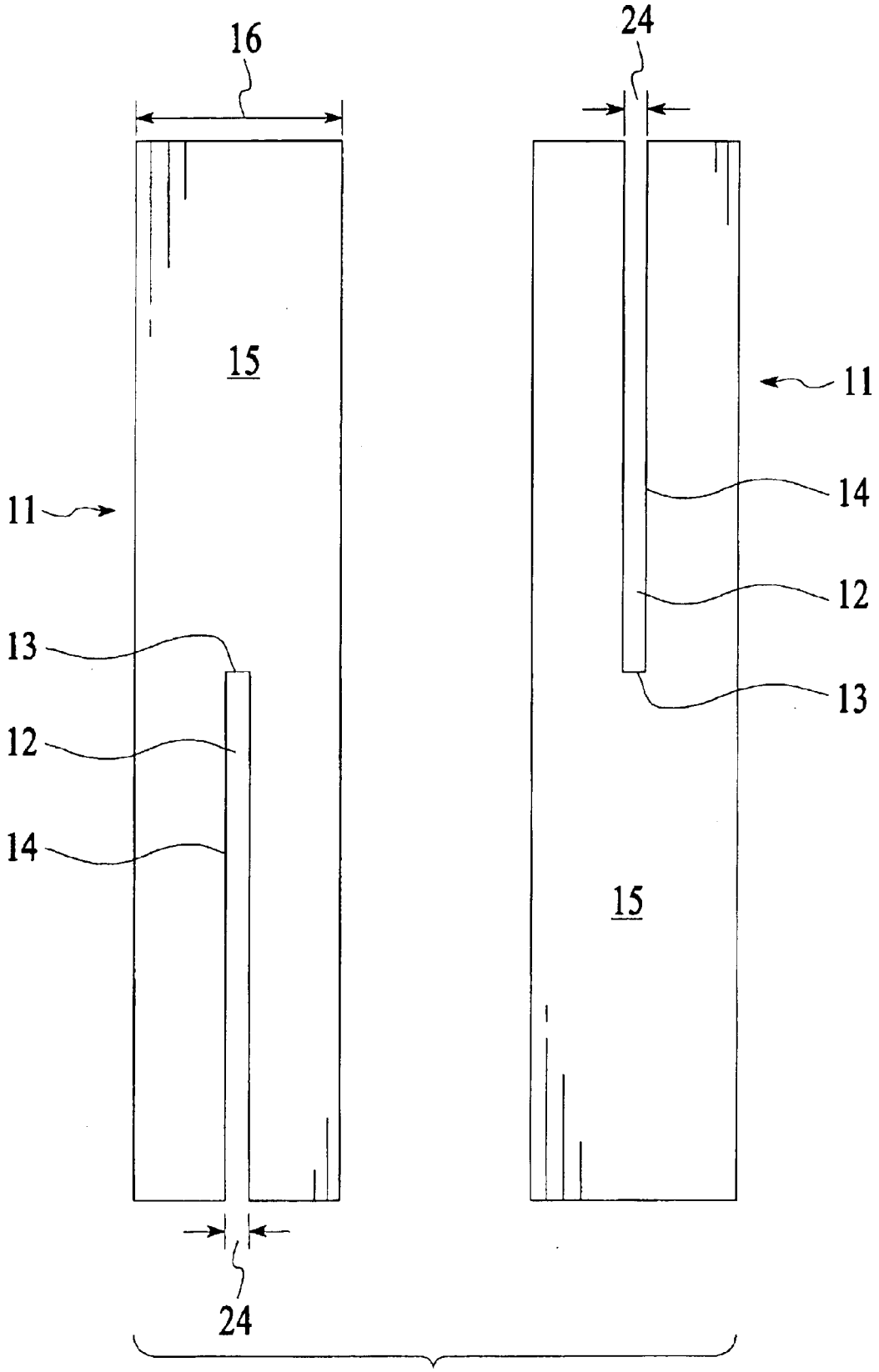
FIG. 1 is a schematic diagram of column members before assembly into an interlocked column.

The interlocked columns of the invention are assembled, e.g., from column members that interlock with each other along slits. FIG. 1, shows an example of column members 11 laid out before assembly by interlocking. During assembly, slits 12 from each column member are aligned and slid into each other until slit ends 13 come in contact. Slit sides 14 slide closely across the surface of non-slit portions 15 during assembly to provide a close fit between column members after they are interlocked. Interlocked column members display considerable strength in three dimensions as an interlocked column unit.

Figure 2A:
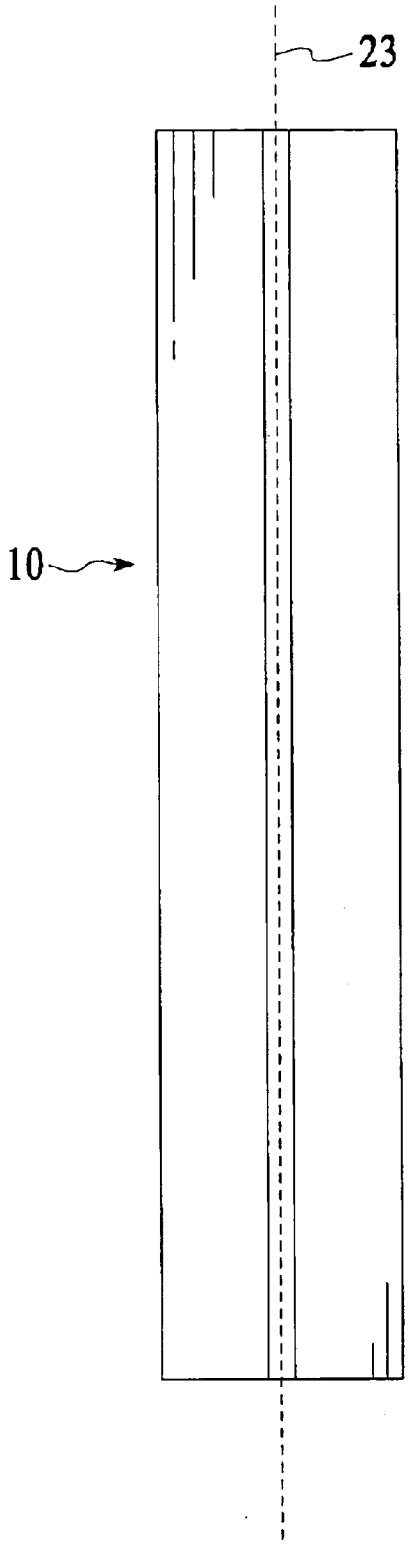
FIG. 2A is a schematic diagram of an interlocked column and FIG. 2B shows a cross section high on the interlocked column.
Figure 2B:
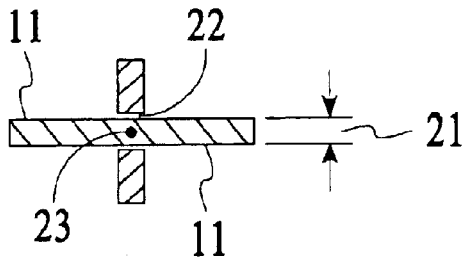

Once the column members are assembled into an interlocked column, they can resist relative motion due to external forces. For example, the planes of the column members have, e.g., a thickness that contacts a broad area of the other column member so as to prevent axial rotation relative to each other. FIG. 2A shows interlocked column 10 and FIG. 2B shows a cross section of the column. Thickness 21 through the plane of column members 11 provides contact surfaces 22 that restrict relative motion about axis 23. Relative rotation of column members about the axis can be further prevented by bonding and/or by tight fitting of a planar member about the cross section, as described below.

Interlocked column members can resist displacement or rotation across the axis. Column members can be fabricated, e.g., so that thickness 21 through the plane of one member is substantially equal to slit width 24 of the other interlocked member. In such an arrangement, there is full contact, or at least a point of contact, between slit sides 14 of one member and the non-slit portion 15 surface of the other member, thus providing no space for relative lateral motion of the column members across the axis 23. A tight fit between the column members can be enhanced by providing a wedge fit wherein the dimensions of a slit width or member thickness tapers to receive the other member in a progressively tighter association, as is understood by those in the art.

Relative motion of interlocked column members can be minimized by optionally fixing one to the other. For example, an adhesive of cement can be applied to contact surfaces of the members to permanently bond each to the other. Alternately, the interlocked column members can be fixed to each other with nails, screws, dowels, and the like.

Figure 3:
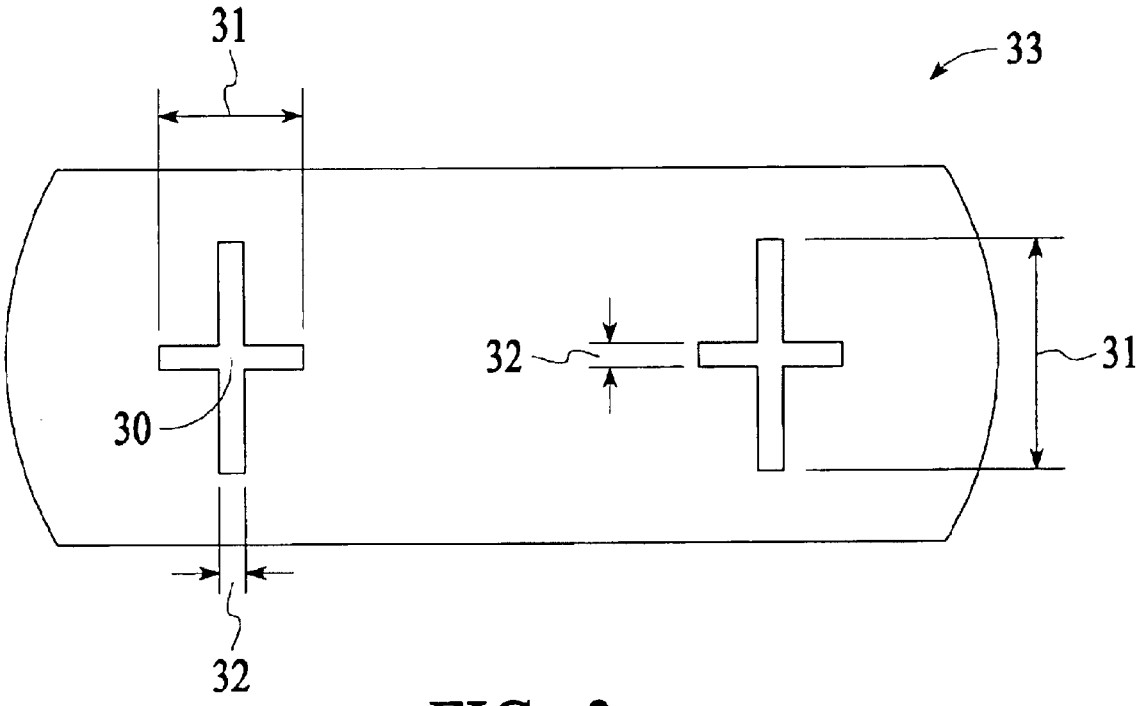
FIG. 3 is a schematic diagram of a planar member.

Relative motion of the interlocked column members can be minimized, e.g., by a tight association with planar members. Column width 16 of the column members can be substantially equal to pierce span 31 of the planar members (see FIG. 3) thus preventing relative lateral movements of the column members. Thickness 21 of the column members can be substantially equal to pierce width 32 of the planar member thus preventing relative column member rotation about column axis 23. The column width or column member thickness can be tapered so that the interlocked column becomes wedged into the pierced region of the planar member as the interlocked column is inserted into the planar member during assembly.

Figure 4A:
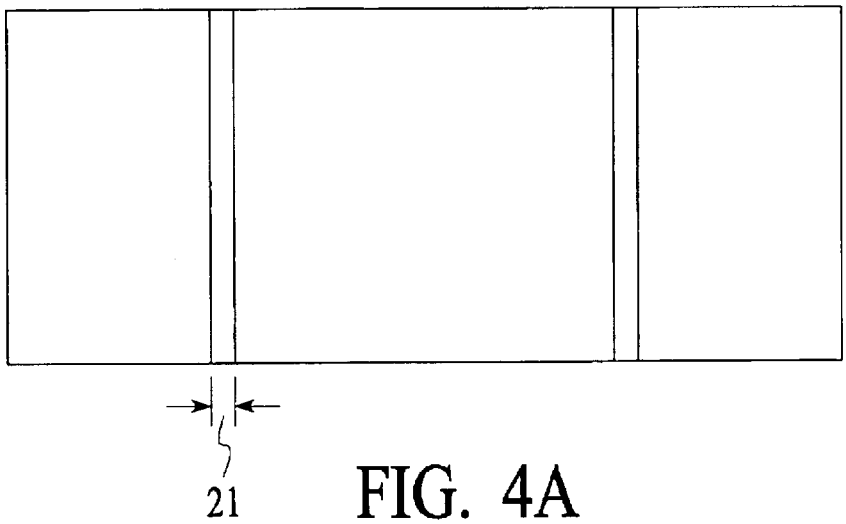
FIG. 4A is a frontal view an interlocked column assembled from more than two column members.
Figure 4B:
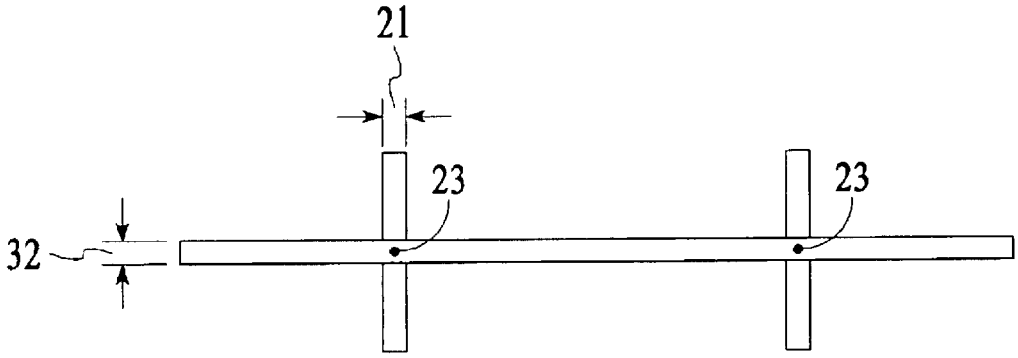
FIG. 4B is a cross section through the column.

More than two column members can be mutually interlocked to form an interlocked column. For example, as shown in FIGS. 4A (front view) and 4B (top view), first column member 11A can have 2 or more slits to receive 2 or more other column members 11B. Such an arrangement can provide a broad wall column member between end column members to block a view, or form a furniture part, such as a seat back.

Diagonal braces can be provided to further enhance rigidity to lateral forces in the structural system. For example, in a structure with two interlocked columns, diagonal wires or rods can run diagonally from the top of the first column to the bottom of the second column and from the bottom of the first column to the top of the second column. Optionally, triangular wedges of sturdy material can be closely mounted where planar members and interlocked columns join to provide a diagonal brace which inhibits articulation at the point of contact. In one embodiment, the triangular wedge is, e.g., mounted to an angled clip (described below in the Mounting Fixtures section) on the contact section opposite the planar member.

Column members can have a curvature. For example, a curved column member can be received into a curved slit of another member.

In some embodiments, the interlocked columns can be mounted on a base member to provide a broader base for better stability and lower floor contact pressures. The base member can be, e.g., a simple sheet, or a raised structure that brackets the entire column bottom end. In one embodiment, the column bottom end rests on a rigid sheet of material with mounting by adhesives, L-brackets, screws, and/or the like. In another embodiment, the base member is a thicker structure with an "X" shaped recess adapted to receive and support the bottom end of the interlocked column.

Planar Members

The planar members of the structural system generally provide, e.g., a horizontal surface such as a floor, shelf, ceiling, seat, roof, table, counter, platform, or the like, for structures of the invention. The planar members are supported, e.g., by the interlocked columns of the invention. The planar members can surround the column members to wedge, lock, or otherwise restrict movement of the interlocked column.

Planar members can be, e.g., pierced sheets of a sturdy material. As show in FIG. 3, the pierced region of the planar members can have an "X" shape generally adapted to closely fit a cross section of the interlocked column to which it will be mounted. As described above in the Interlocked Columns section, pierced region 30 can have pierced span 31 substantially equal to the column width 16 of the associated supporting column members. Pierced width 32 can be substantially equal to the thickness 21 of the associated supporting column members. The close fit of the planar member to the cross section of the supporting interlocked column can provide a wedge fit, and/or close proximity for mounting fixtures. The close fit can seal the space between the interlocked column and planar member to prevent objects resting on the planar member from falling down along the interlocked column. The close fit can compress, surround and otherwise restrict movement of the column members, thereby adding strength and rigidity to the overall structure system.

The planar member can be mounted to the interlocked column in any fashion known in the art. For example, an interlocked column with column members tapered in width and/or thickness can be inserted into the pierced region of a planar member until it becomes wedged in the span or width. The planar member can optionally be permanently mounted to an interlocked column using an adhesive, cement, nail, screw, and/or the like. Alternately, a planar member can be mounted to an interlocked column using a system of pegs, holes and/or slips as described below in the Mounting Fixtures section.

Mounting Fixtures

Mounting fixtures can be used to mount planar members to interlocked columns of the invention. Any technique known in the art can be used to mount the planar members to the interlocked columns including, e.g., adhesives, nails, screws, dowels, wedges, dove tails, pegs, clips, and the like.

In a particular embodiment, the interlocked columns have holes along the outer edges or surfaces to receive pegs. In FIG. 5, peg 50 is inserted into column hole 51 so that a part of the peg remains extending out from the interlocked column. As interlocked column 10 is inserted into the pierced region of planar member 33, the outward extension of the peg blocks further insertion on contact the planar member. The planar member is supported on the pegs against sliding further down the interlocked column. To further limit the movement of the planar member along the interlocked column, additional holes and pegs can be located on the other side of the planar member; this can prevent the planar member from moving out of position should the interlocked column be inverted.

Figure 5A:
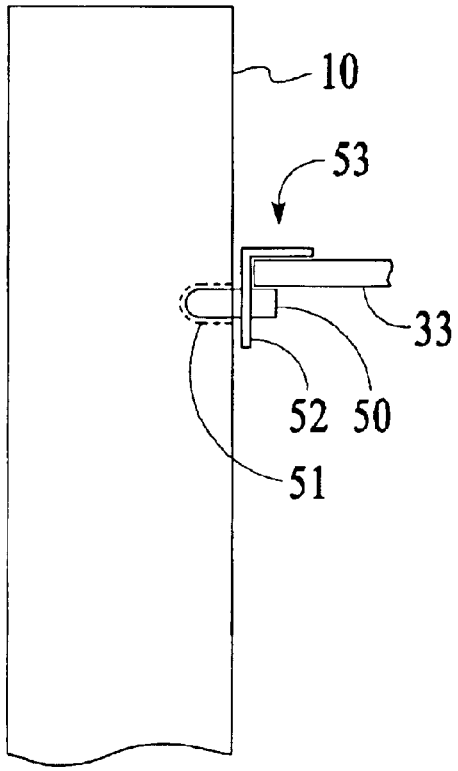
FIG. 5 is a schematic diagram of a peg and clip system for mounting planar members to columns.
Figure 5B:
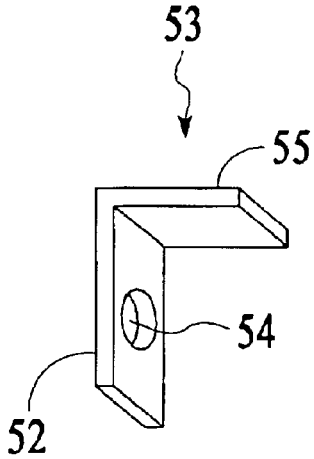

Another way to lock a planar member in position on an interlocked column is to use a peg on one side of the planar member and an angled clip inserted from the other side. In this embodiment, as shown in FIGS. 5A and 5B, a first perforated section 52 of angled clip 53 is inserted between the planar member and the interlocked column so that clip perforation 54 aligns with column hole 51. Then peg 50 is inserted through clip perforation 54 and into column hole 51. This arrangement leaves the planar member mounted to the interlocked column between a peg on one side and clip contact section 55.

Furniture

Various articles of furniture can be fabricated from the interlocked columns and planar members of the invention. For example, four interlocked columns can make up the four corner poses of a chair. A Planar member, having pierced regions at four corners, can be mounted to the interlocked columns as a seat. A back support made of several traversing planar members can be mounted above the seat on two of the interlocked columns. Alternately, the back support can be a broad column member extending across to interlock with two end column members acting as corner posts.

A table can be configured from the structural frame system of the invention, e.g., by establishing four interlocked columns to act as legs mounted at the four corners of a broad deep planar member acting as the table surface. Additional planar members can extend between pairs of table legs to provide additional stability and sub-shelving for the table.

A desk can be configured from the structural system of the invention, e.g., by essentially providing a four cornered table with additional tiers of column and planar member shelves above and or below the table surface. Handled boxes can fit into spaces between interlocked columns and shelf tiers to act as drawers.

Figure 6:
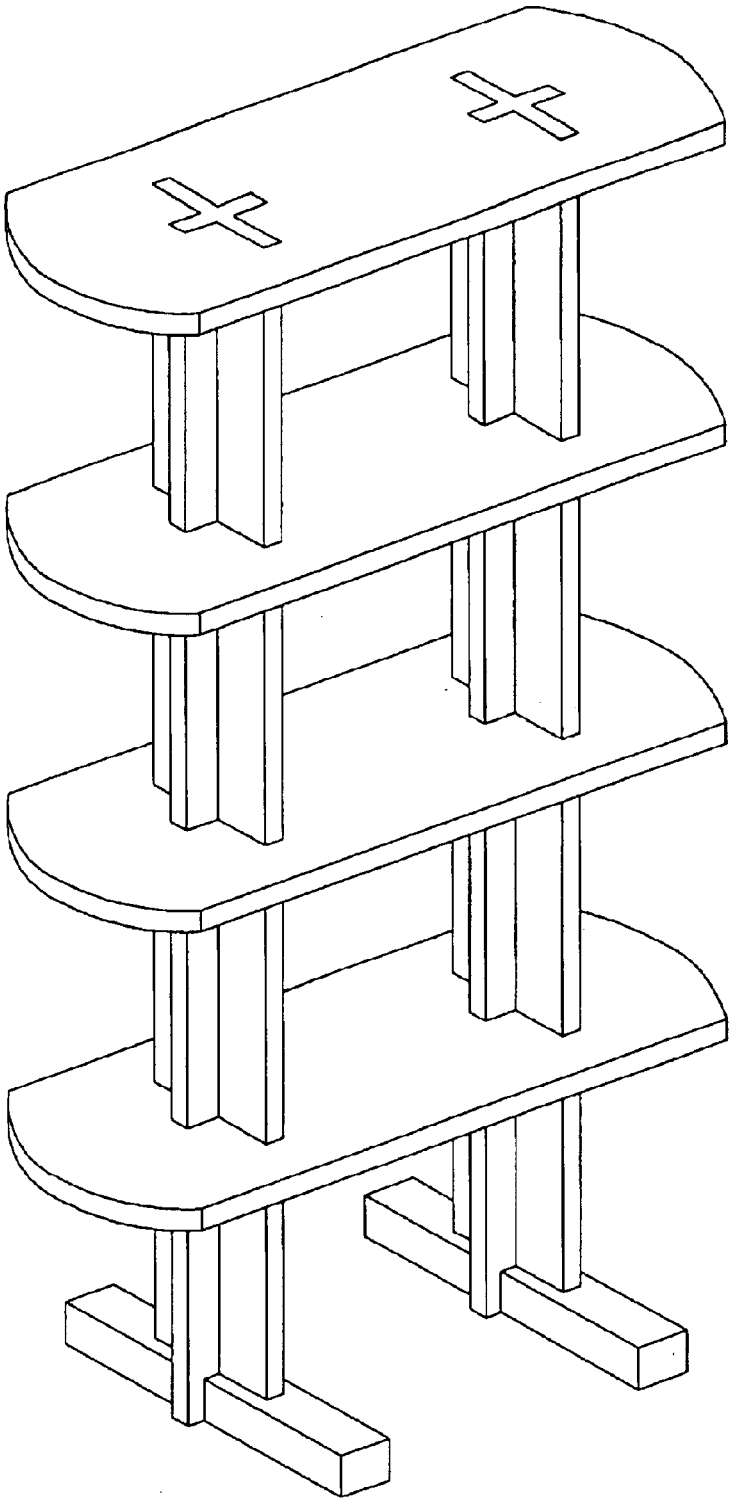
FIG. 6 is an exemplary shelf system of the invention.
Figure 7:
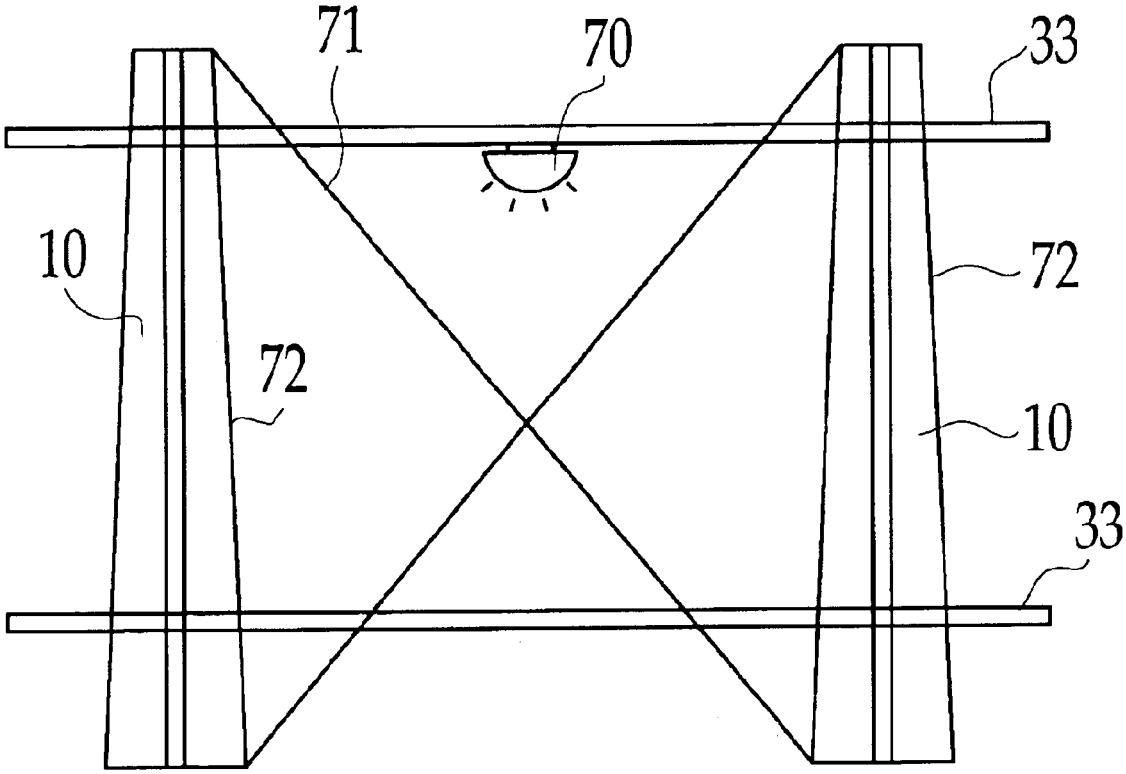
FIG. 7 is a schematic diagram of a structural system of the invention configured as a shelf system having electrical light 70, diagonal braces 71, and interlocked columns 10 having tapered outer edges 72. Planar members 33 can be mounted by wedging pierced regions onto the interlocked column cross section.

A shelf system can be configured from the structural system of the invention, as shown in FIG. 6. For example, two or more interlocked columns can support one or more long planar members to provide a book shelf.

Methods

The methods of the invention include procedures, e.g., to manufacture furniture from the column members, planar members and mounting fixtures of the invention. A basic assembly process of the invention includes, e.g., interlocking column members, sliding the interlocked column into the pierced region of a planar member and mounting the planar member onto the interlocked column.

Column members can be interlocked by passing each column member slit one into the other until the slits begin to slide over non-slit portion surfaces of the other member and finally the inner slit ends abut. In some embodiments, where the slits or column member thickness is tapered, the column members can be slid into one another until the members become wedged together.

The interlocked column can be inserted into the pierced region of a planar member adapted to receive and surround the cross section of the interlocked column. The planar member can be mounted to the column member by wedging if the interlocked column has a tapered column member thickness or column width, as described above in the Interlocked Column section. Alternately, the planar member can be mounted to the interlocked column by inserting one or more pegs into holes in the interlocked column with part of the pegs remaining extended out from the interlocked column. The planar members can be supported on the peg extensions. For additional mounting security, the planar member can be mounted by inserting perforated sections of one or more angled clips between the planar members and the interlocked columns so that clip perforations align with holes in the interlocked column. The pegs are inserted into the holes, as before, but they also capture the perforated sections of the clips to lock the clips in place with the clip contact section holding the other side of the planar member.

Unassembled structures and furniture of the invention are readily packaged for storage or shipment. As the structural members of the invention are generally fabricated from sheet material, they can be arranged in compact stacks when not interlocked for use.

It is understood that the examples and embodiments described herein are for illustrative purposes only and that various modifications or changes in light thereof will be suggested to persons skilled in the art and are to be included within the spirit and purview of this application and scope of the appended claims. All publications, patents, and patent applications cited herein are hereby incorporated by reference in their entirety for all purposes.

What is claimed is:

1. A structural system comprising:

three or more column members and one or more planar members;

the column members each comprising one or more slits adapted to receive non-slit portions of one or more other column members to form one or more interlocked columns; and, the planar members comprising one or more pierced regions adapted to receive the one or more interlocked columns through the one or more pierced regions, wherein the pierced regions contact one or more edges of the column members but not an end of the one or more column members or wherein one or more of the pierced regions is not a recess;

whereby the planar members surround one or more cross sections of the interlocked columns and mount to the interlocked columns, thereby providing a structural system of one or more planar members supported by one or more interlocked columns.

2. The structural system of claim 1, wherein two interlocked columns support two or more planar members.

3. The structural system of claim 1, further comprising a base member having one or more recesses adapted to receive an interlocked column bottom end, thereby providing a base surface.

4. The structural system of claim 1, further comprising one or more pegs, wherein the one or more interlocked columns further comprise one or more holes along an outer edge or surface which receive the pegs wherein the outer edge is not an end of the one or more interlocked columns, and which pegs extend in part from the interlocked columns, whereby the planar members mount to the interlocked columns with support from the pegs by contact with a first planar member side.

5. The structural system of claim 4, wherein the support from the pegs comprises contact with a second planar member side.

6. The structural system of claim 4, further comprising an angled clip with a perforated section comprising a perforation, and a clip contact section;

wherein the perforated section extends between the planar member and the interlocked column with the perforation aligned with the hole; and, with the clip contact section in contact with a second planar member side;

whereby the hole receives the peg through the perforation, thereby mounting the planar member between the peg and the clip contact section.

7. The structural system of claim 1, wherein the planar members form a shelf, a table top, a desk top, a seating surface, a ceiling, a floor, a drawer support, or a counter top.

8. A method of manufacturing a structural system, the method comprising:

fabricating three or more column members;

fabricating one or more planar members, which planar members comprise one or more pierced regions;

interlocking the three or more column members to form one or more interlocked columns; and, inserting one or more of the interlocked columns through one or more of the pierced regions, wherein the one or more pierced regions contact one or more edges of the one or more column members but not an end of the one or more column members, thereby surrounding one or more cross sections of the interlocked columns with the planar members; and, mounting the planar members to the interlocked columns, thereby manufacturing the structural system of planar members supported by interlocked columns.

9. The method of claim 8, wherein fabricating column members or planar members comprises cutting sheet stock or injection molding.

10. The method of claim 8, wherein mounting comprises inserting one or more pegs into holes in an outer edge or surface of the one or more interlocked columns and supporting the planar members on the pegs, wherein the outer edge is not an end of the interlocked column.

11. The method of claim 10, wherein mounting further comprises:

inserting perforated sections of one or more angled clips between the planar members and the interlocked columns so that clip perforations align with the holes;

whereby the holes receive the pegs through the perforations;

thereby mounting the planar member between the peg in contact with a first planar member side and a clip contact section in contact with a second planar member side.

* * * * *